US005255414A

United States Patent [19]

March

[11] Patent Number: 5,255,414

[45] Date of Patent: Oct. 26, 1993

[54] REPLACEMENT HANDLE FOR SUITCASE, ATTACHE CASE AND THE LIKE

[76] Inventor: Kenneth R. March, 2244 Carroll Mill Rd., Phoenix, Md. 21131

[21] Appl. No.: 867,536

[22] Filed: Apr. 13, 1992

[51] Int. Cl.[5] ..... B25G 3/28; E05B 7/00

[52] U.S. Cl. ..... 16/125; 16/116 R; 16/126; 190/115

[58] Field of Search ..... 190/115, 116, 117; 16/110 R, 124, 125,

[56] References Cited

U.S. PATENT DOCUMENTS

| | | | |
|---|---|---|---|
| 230,572 | 7/1880 | Reichenbach . | |
| 840,978 | 1/1907 | Welch . | |
| 988,896 | 4/1911 | Quinn . | |
| 1,188,547 | 6/1916 | Lopez . | |
| 1,286,366 | 12/1918 | Lorden . | |
| 1,376,528 | 5/1921 | Grant . | |
| 1,376,529 | 5/1921 | Grant . | |
| 1,742,867 | 1/1930 | Levi . | |
| 1,775,843 | 9/1930 | Birbaum . | |
| 1,808,890 | 6/1931 | Grant . | |
| 2,397,651 | 4/1946 | Doppelt | 40/20 |
| 2,537,750 | 1/1951 | Gretschel | 190/58 |
| 2,703,160 | 3/1955 | Lifton | 190/57 |
| 2,713,926 | 7/1955 | Finkelstein | 190/57 |
| 3,016,136 | 1/1962 | Poupitch | 206/56 |
| 3,176,326 | 4/1965 | Zysman et al. | 5/345 |
| 3,653,474 | 4/1972 | Sadow | 190/18 A |
| 3,963,104 | 6/1976 | Lautin | 190/58 R |
| 4,276,676 | 7/1981 | Stolarz | 16/126 |
| 4,340,990 | 7/1982 | Syenhaeve | 16/126 |
| 4,424,841 | 1/1984 | Smith | 150/33 |
| 4,658,467 | 4/1987 | Stolarz | 16/126 |
| 4,663,802 | 5/1987 | Kunzler | 16/124 |
| 4,754,858 | 7/1988 | Robinson | 190/115 |

*Primary Examiner*—W. Donald Bray
*Attorney, Agent, or Firm*—Leonard Bloom

[57] ABSTRACT

A replacement handle is disclosed that may be retrofit for use on conventional suitcases, attache cases and the like having conventional posts, links and the like formed thereon. The handle includes a body portion having a pair of opposite ends. Formed on the opposite ends are respective tails. The tails have teeth formed thereon. Formed in each of the opposite ends are respective "one-way" openings. Once a handle is removed from the conventional case, the tails may be wrapped or looped around the conventional posts, links and the like and then the portion of the tails having the teeth formed thereon may be inserted into the respective openings where they are maintained for use therewith.

10 Claims, 4 Drawing Sheets

REPLACEMENT HANDLE FOR SUITCASE, ATTACHE CASE AND THE LIKE

FIELD OF THE INVENTION

The present invention relates to handles and, in particular, to replacement handles for suitcases, attache cases and the like.

BACKGROUND OF THE INVENTION

Suitcases, attache cases and the like are commonly provided with a handle which may be gripped by a user for the carrying thereof. All manners of handles for suitcases, attache cases and the like have been disclosed. Examples of such handles, of which I am aware include the following U.S. Letters Patent:

| Inventor(s) | U.S. Pat. No. | Year of Issue |
|---|---|---|
| Reichenbach | 230,572 | 1880 |
| Welch | 840,978 | 1907 |
| Lipton | 2,703,160 | 1955 |
| Finkelstein | 2,713,926 | 1955 |
| Lautin | 3,963,104 | 1976 |

A common problem that is often confronted with suitcases, attache cases and the like is what to do when the handle thereof breaks or becomes otherwise damaged, such that one is not able to carry the suitcase, attache case and the like with the use of the handle. This problem of handle breakage is aggravated by the fact that such handles are not replaceable.

In an attempt to remedy the problems of handle breakage, various arrangements have been disclosed wherein the handle of a suitcase, attache case and the like is removable therefrom, such that these handles may be replaced if broken or otherwise damaged. Such handles, of which I am aware, are as follows:

| Inventor(s) | U.S. Pat. No. | Year of Issue |
|---|---|---|
| Quinn | 988,896 | 1911 |
| Lopez | 1,188,547 | 1916 |
| Lorden | 1,286,366 | 1918 |
| Grant | 1,376,528 | 1921 |
| Grant | 1,376,529 | 1921 |
| Levi | 1,742,867 | 1930 |
| Birbaum | 1,775,843 | 1930 |
| Grant | 1,808,890 | 1931 |
| Gretschel | 2,537,750 | 1951 |
| Stolarz | 4,276,676 | 1981 |
| Seynhaeve | 4,340,990 | 1982 |
| Stolarz | 4,658,467 | 1987 |
| Kunzler | 4,663,802 | 1987 |

While being useful for their intended purposes, such handles are nonetheless limited in that they are useable only with specific arrangements, which are often complicated and expensive. None of these handles may be retrofit for use with all suitcases, attache cases and the like of different varieties that have a pair of posts, links and the like formed thereon.

While, as evidenced in U.S. Letters Patent Nos. 2,397,651 issued to Doppelt and 4,424,841 issued to Smith, the use of straps has been employed for attaching name tags and to provide a handle in of itself, to the best of my knowledge, there are no arrangements of which I am aware wherein a replacement handle is provided that may be secured to the suitcase, attache case and the like by the use of straps.

Thus, it can be seen that there remains a need for a replacement handle for a briefcase, attache case and the like of the type having a pair of posts, links and the like which is simple and inexpensive in construction and which may be retrofit to be utilized with virtually and briefcase, attache case and the like.

SUMMARY OF THE INVENTION

A primary object of the present invention is to provide a replacement handle for briefcases, attache cases and the like which is simple and inexpensive in construction.

It is a further primary object of the present invention to provide such a replacement handle which may be retrofit for use with various existing briefcases, attache cases and the like.

In accordance with the teachings of the present invention, a replacement handle is disclosed for use with a suitcase, attache case and the like of the type having a pair of posts, links and the like formed thereon. The handle includes a body portion including a pair of ends. Each of the ends of the body portion has a respective opening formed therein. Each of the ends of the body has a respective tail formed thereon which is integral therewith. In this fashion, each of the tails loops around the respective posts, links and the like and is received in the respective openings.

Finally, means is formed between each of the tails and the openings in which they are received for securing each of the tails in the respective openings.

In a preferred embodiment, the means for securing each of the tails in the respective openings is comprised of the openings being "one-way" openings and the tails include at least one ratchet tooth formed thereon for cooperating with the respective "one-way" openings in which they are received. In this manner, each of the tails is secured in the respective openings.

It is further preferred that a plurality of such ratchet teeth are formed on the tails, so that the tails may be adjustably secured in the respective openings.

In another embodiment, each of the tails includes a respective enlarged portion. The enlarged portion of each tail is integral with the end of the body portion. In this manner, the enlarged portion of each tail loops around one of the respective posts, links and the like for providing additional support therebetween.

In still another embodiment, the openings each have walls, and each of said walls have at least one notch formed thereon. The tails each include at least one fastening means formed thereon. The at least one fastening means cooperate with the at least one respective notches formed in the walls of the openings in which the tails are received. In this manner, each of the tails is received in the respective openings.

These and other objects and advantages of the present invention will be come readily apparent from a reading of the following description when taken in conjunction with the enclosed drawings.

BRIEF DESCRIPTION OF THE DRAWINGS

FIG. 3 is a perspective view of the broken handle of FIG. 1 illustrating the manner of removing said broken handle from posts, links and the like of the suitcase, attache case and the like.

DESCRIPTION OF PREFERRED EMBODIMENTS

Figure 1:
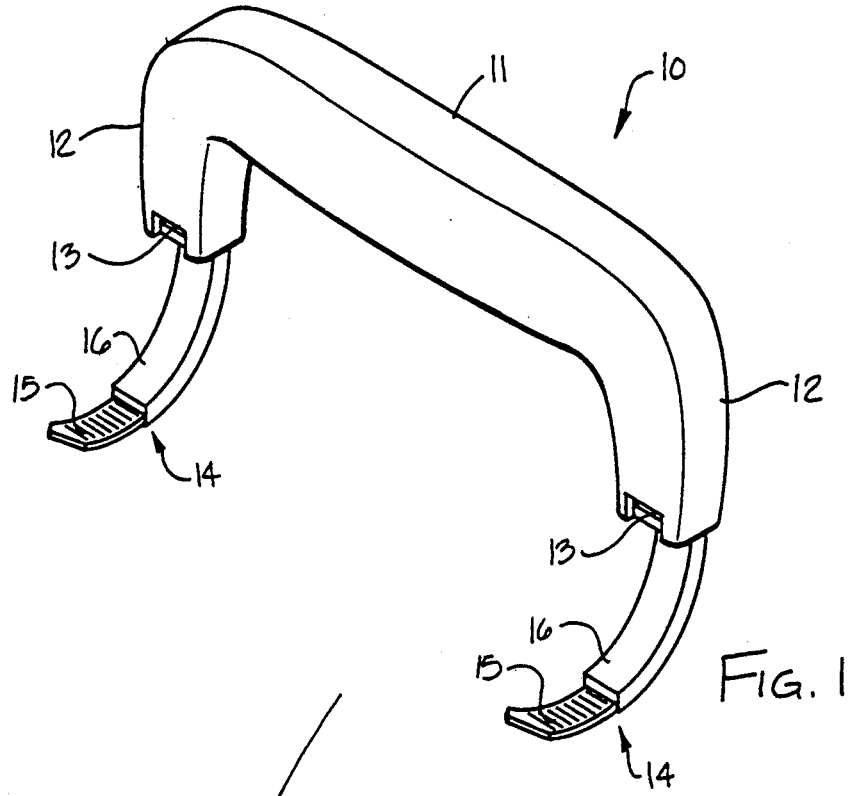
FIG. 1 is a perspective view of the replacement handle of the present invention.

Referring now to the drawings, and in particular to FIG. 1, the replacement handle 10 of the present invention is illustrated.

The handle 10 of the present invention includes a body portion 11. The body portion 11 includes a pair of ends 12. Each of the ends 12 has a respective opening 13 formed therein.

Each of the ends 12 of the body portion 11 has a respective tail 14 formed thereon. These tails 14 are substantially flexible and extend outwardly from the ends 12 of the body portion 11. Each of said tails 14 is further integral with the end 12 of the handle 10 on which they are formed.

Formed in the above fashion, the tails 14 may, as shall be discussed at length below relative to FIG. 4, be looped around the respective posts, links and the like that are formed on the suitcase and received in the respective openings 13.

Formed between each of the tails 14 and the opening 13 in which they are received are means for securing each of the tails 14 in the respective openings 13.

The means for securing the tails 14 in the respective openings 13 includes the openings 13 being "one-way" openings. The means further includes at least one ratchet tooth 15 formed on each tail 14. Such ratchet teeth 15 are formed for cooperating with the "one-way" openings 13 in which they are received, such the tails 14 are secured in the respective openings 13. By use of the term "one-way" openings 13, what is meant are openings which permit the tail 14 having the teeth 15 formed thereon to be inserted therein but not to be removed therefrom.

Preferably, each of the tails 14 has a plurality of such teeth 15 formed thereon for cooperating with the respective "one-way" openings 13 in which they are received. The teeth 15 may be formed on one side of the tail or on both sides of the tail. In this manner, each of the tails 14 may be adjustably secured in the respective openings 13. Such a feature permits the replacement handle 10 of the present invention to be retrofit, in a manner that will be discussed at length below, to suitcases, attache cases and the like having posts, pins and the like of varying sizes.

Each of the tails 14 further includes respective enlarged portions 16. These enlarged portions 16 are the portion of the tail 14 that is integral with the ends 12 of the body portion 11 of the handle 10. In this manner, additional strength is provided to the replacement handle 10, especially at that part of the handle 1 most likely to have stresses placed thereon. Further in this manner, as shall be discussed at length below, it is the enlarged portions 16 of each tail 14 which loops around the respective posts, links and the like, whereby additional support is provided therebetween, especially at that part of the handle 10 most likely to have stresses placed thereon which may cause the handle to break.

It is contemplated herein that the replacement handle 10, including the body portion 11, ends 12, tails 14, teeth 15 and enlarged portions 16 thereof will be fabricated from lightweight, durable plastic. However, it is to be clearly understood that any suitable material, such as metal, etc., may be utilized with equal vigor.

Figure 6A:
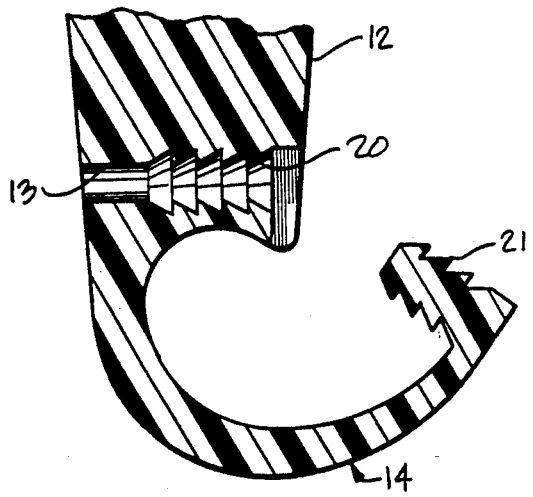
FIGS. 6A-D are cross sectional views corresponding to FIG. 5 illustrating alternate embodiments of the present invention.
Figure 6B:
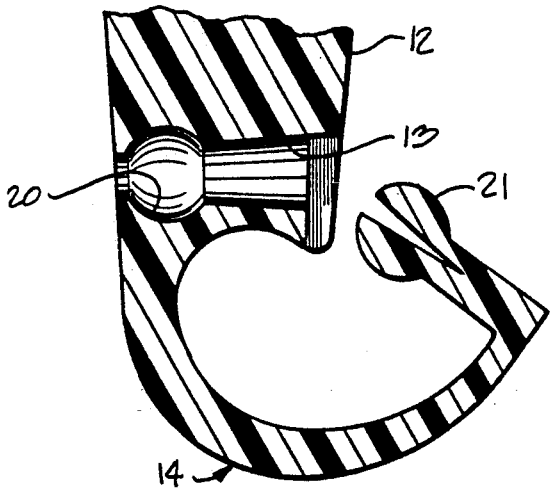
Figure 6C:
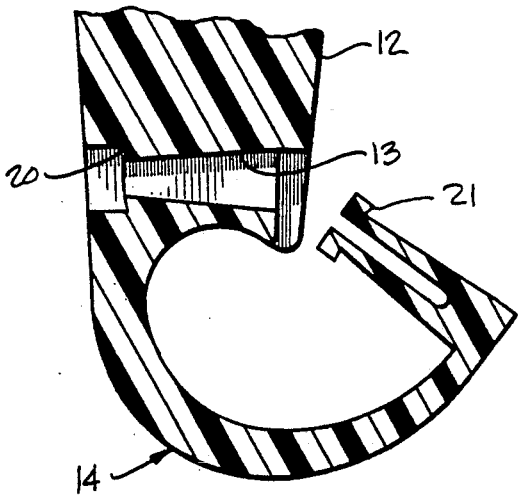
Figure 6D:
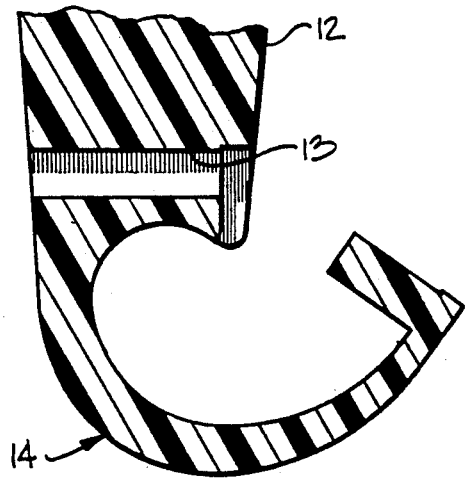

In an alternate embodiment, each opening 13 has walls and each of the walls has at least one notch 20 formed thereon. The respective tails 14 each has at least one fastening means 21 formed thereon. When the user inserts the portion of the tail 14 having the fastening means 21 formed thereon, into the respective opening 13, the fastening means 21 cooperates with the notch 20 in the wall of the opening 13 and firmly secures the tail 14 in the respective opening 13. FIGS. 6A-C are examples of notch 20 and fastening means 21 which may be used but the notch and fastening means are not limited to these examples. Furthermore, the tail 14 may be secured in the opening 13 by adhesive disposed on the portion of tail 14 received in the opening 13, in the opening 13 or on both (FIG. 6D).

Figure 2:
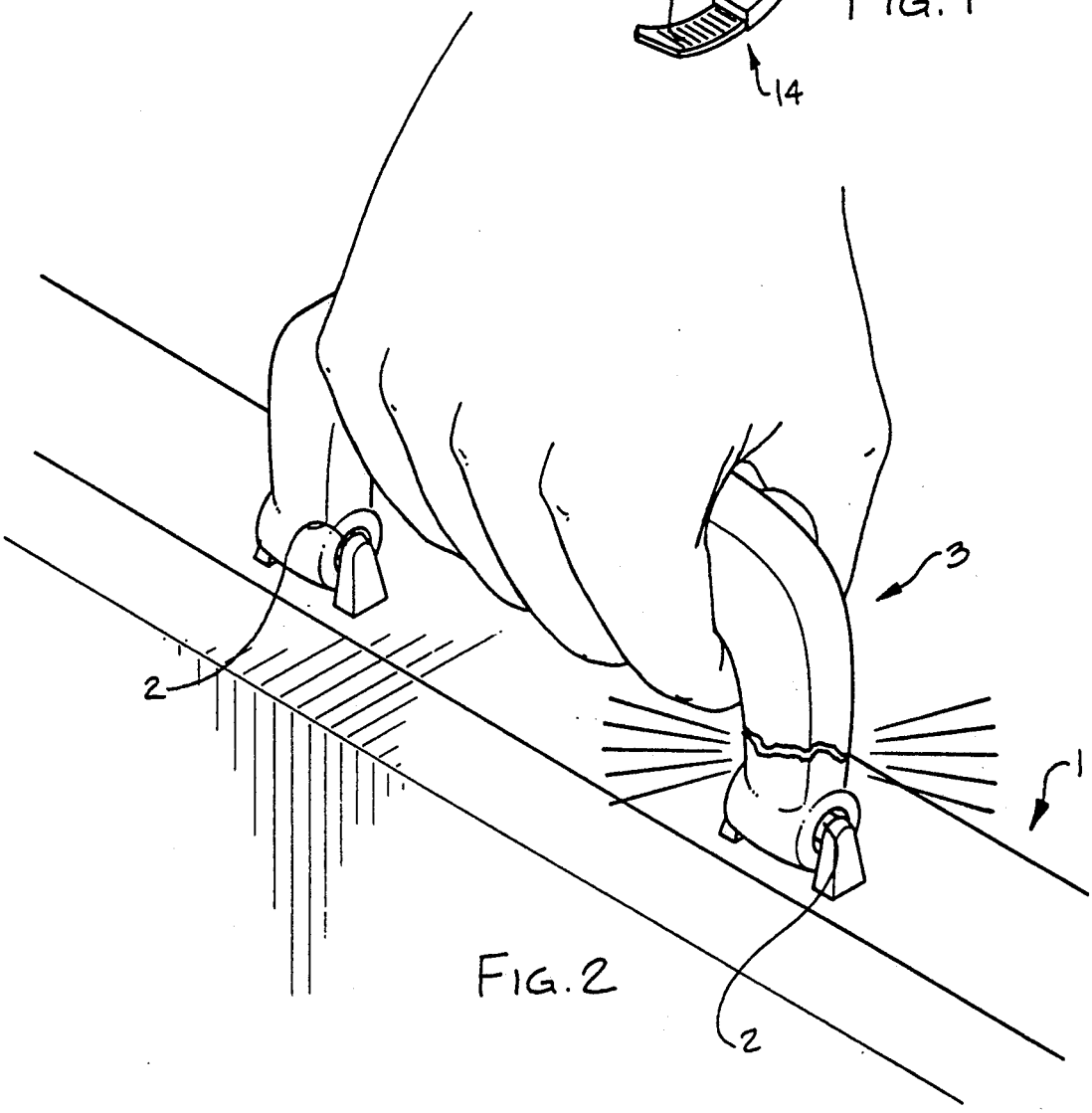
FIG. 2 is a perspective view of the handle of a conventional suitcase, attache case and the like of the type having a pair of posts, links and the like illustrating how the conventional handle break.
Figure 3:
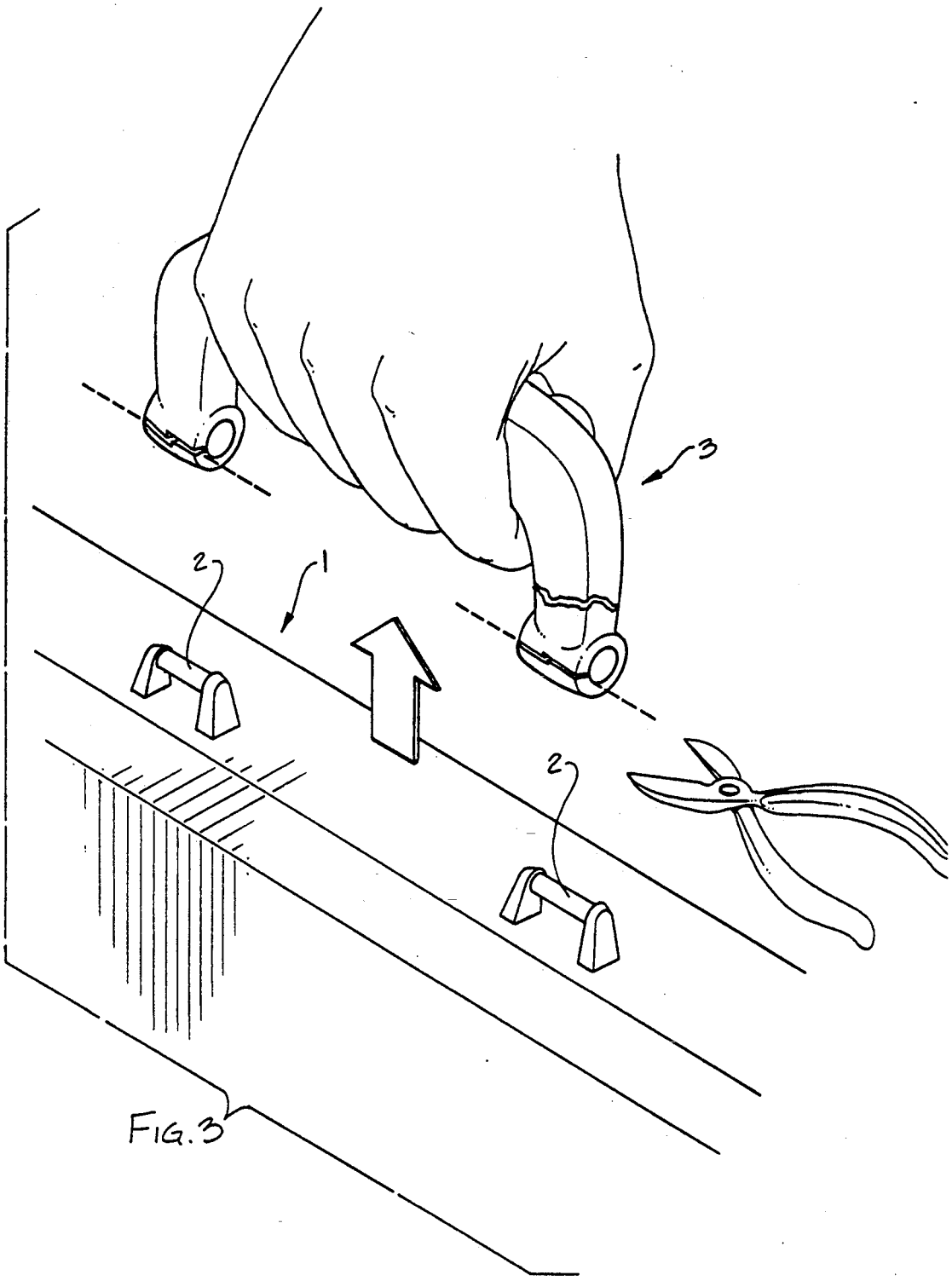
Figure 4:
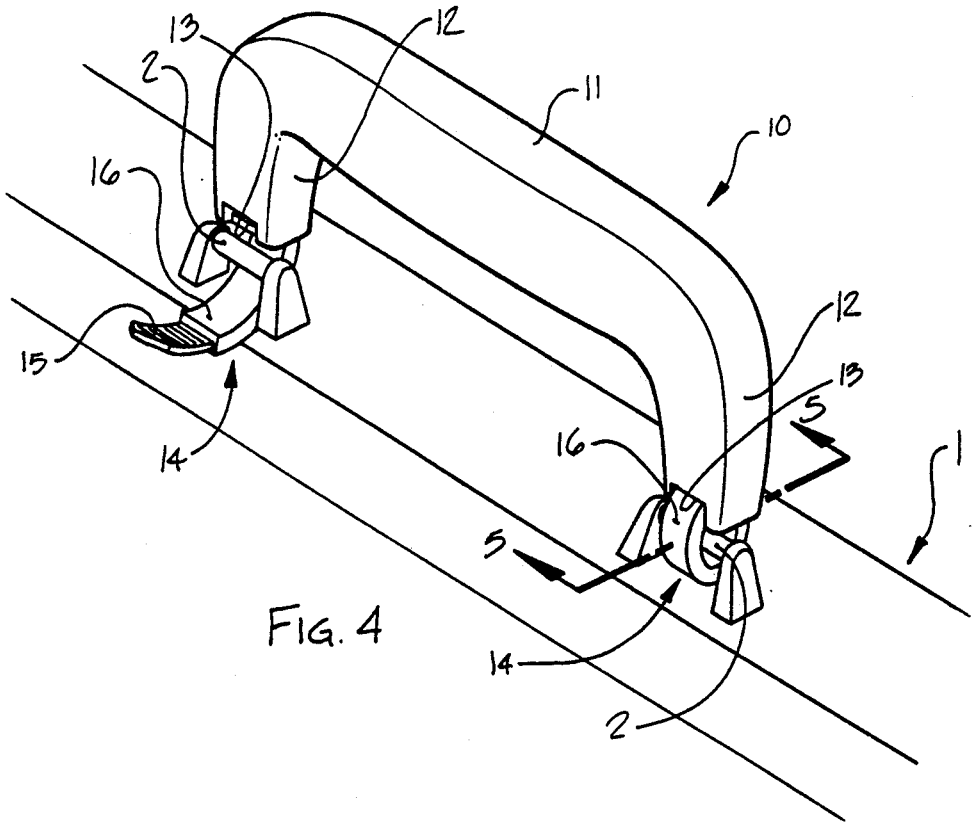
FIG. 4 is a perspective view of the replacement handle of the present invention illustrating the manner in which the replacement handle is retrofit to the posts, links and the like of a suitcase, attache case and the like for use therewith.
Figure 5:
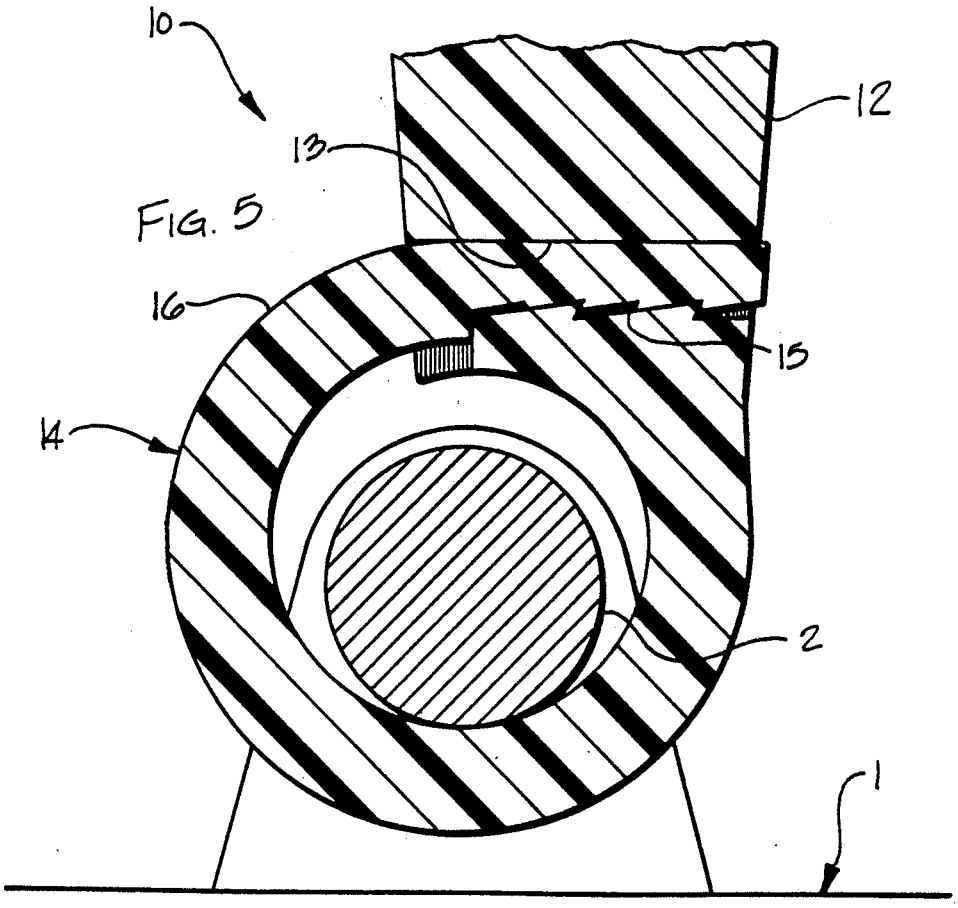
FIG. 5 is a cross section taken across the lines 5—5 of FIG. 4.

Having thus described the replacement handle 10 of the present invention, with reference now to FIGS. 2-4, the use of the replacement handle 10 of the present invention is now discussed.

With reference to FIG. 2, in conventional suitcases, attache case and the like 1 of the type having a pair of posts, links and the like 2, it is common for the handle 3 thereof to break. Such breakage of the handle 3 renders the handle 3 unusable for its purpose of being gripped by a user to support the briefcase 1. This is because these are the portions of the handle which usually have the greatest pressures and tensions exerted thereon.

When the conventional handle 3 of a conventional suitcase, attache case and the like breaks, as was described above, the user thereof will want to employ a scissors, knife or any other suitable means to cut the conventional handle 3 from the conventional links 2 of a conventional case 1 Having thus removed the conventional handle 3, the replacement handle 10 of the present invention may be retrofit thereto, so as to be used therewith.

To retrofit the replacement handle 10 of the present invention to a conventional posts, links and the like 2 of a conventional case 1, one need simply to wrap each of the tails 14, and in particular the enlarged portions 16 of each of the tails 14 around the conventional link or post 2 (FIG. 4). The user then need simply to insert that portion of the tails 14 having the tooth or teeth 15 formed thereon into the respective "one-way" openings 13. The "one-way" openings 13 in conjunction with the teeth 15, secures the tails 14 in the respective openings 13 and prevents them from being inadvertently disengaged therefrom. The alternate embodiments are used in a similar manner by inserting the portion of the tail 14 having the fastening means 21 into the opening 13 so that the fastening means 21 may engage and cooperate with the at least one notch 20 on the wall of the opening 13. The replacement handle 10 is thus retrofit to a conventional case 1 for use therewith.

Accordingly, from the foregoing it can be seen that the replacement handle 10 of the present invention provides a simple, elegant handle capable of being easily and quickly retrofit for use with conventional suitcases, attache cases and the like having conventional posts, links and the like.

Obviously, many modifications may be made without departing from the basic spirit of the present invention. Accordingly, it will be appreciated by those skilled in the art that, within the scope of the appended claims, the invention may be practiced other than has been specifically described herein.

What is claimed is:

1. A handle for a suitcase and an attache case of the type having a pair of posts and links formed thereon, the handle comprised of:

a body portion including a pair of ends, each of the ends of the body portion having a respective opening formed therein;

each of the ends of the body portion having a respective tail formed thereon and integral therewith, so that each of the tails loops around the respective posts and links and is received in said respective openings;

means formed between each of the tails and the openings in which they are received for securing each of the tails in the respective openings.

2. The handle of claim 1, wherein the means for securing each of the tails in the respective openings is comprised of:

the openings being "one-way" openings; and the tails including at least one ratchet tooth formed thereon for cooperating with the respective "one-way" openings in which they are received, whereby each of the tails is secured in the respective openings.

3. The handle of claim 1, wherein each of the tails include a respective enlarged portion, the enlarged portion of each tail being integral with the end of the body portion, such that the enlarged portion of each tail loops around one of the respective posts and links, whereby additional support is provided therebetween.

4. The handle of claim 1, wherein each of the tails includes a plurality of ratchet teeth formed thereon for cooperating with the respective "one-way" openings in which they are received, whereby each of the tails may be adjustably secured in the respective openings.

5. The handle of claim 1, wherein the means for securing each of the tails in the respective openings is comprised of:

the openings each have walls, each of said walls having at least one notch formed thereon, the tails each include at least one fastening means formed thereon for cooperating with said respective notch formed on the walls of the openings in which the tails are received, whereby each of the tails is secured in the respective openings.

6. The handle of claim 1, wherein the means for securing each of the tails in the respective openings is an adhesive disposed between the respective tail and the opening in which said tail is received.

7. A handle for a suitcase and an attache case of the type having a pair of posts and links formed thereon, the handle comprised of:

a body portion including a pair of ends, each of the ends of the body portion having a respective "one-way" opening formed thereon;

each of the ends of the body portion having a respective tail formed thereon, each of the tails including a respective enlarged portion, the enlarged portion of each tail being integral with the end of the body portion, such that the enlarged portion of each tail loops around one of the respective posts and links, whereby support is provided therebetween, and further such that each of the looped tails is received in said respective openings;

each of the tails including a plurality of ratchet teeth formed thereon for cooperating with the respective "one-way" openings in which they are received, whereby each of the tails may be adjustably secured in the respective openings.

8. A handle for a suitcase and an attache case of the type having a pair of posts and links formed thereon, the handle comprised of:

a body portion including a pair of ends, each of the ends of the body portion having a respective "one-way" opening formed therein;

each of the ends of the body portion having a respective tail formed thereon, each of the tails including a respective enlarged portion, the enlarged portion of each tail being integral with the end of the body portion, such that the enlarged portion of each tail loops around one of the respective posts and links, whereby support is provided therebetween, and further such that each of the looped tails is received in said respective openings;

each of the tails including at least one ratchet tooth formed thereon for cooperating with the respective "one-way" openings in which they are received, whereby each of the tails may be secured in the respective openings.

9. A handle for a suitcase and an attache case of the type having a pair of posts and links formed thereon, the handle comprised of:

a body portion including a pair of ends, each of the ends of the body portion having a respective opening formed therein; each opening having walls, each of said walls having at least one notch formed thereon;

each of the ends of the body portion having a respective tail formed thereon, each of the tails including a respective enlarged portion, the enlarged portion of each tail being integral with the end of the body portion, such that the enlarged portion of each tail loops around one of the respective posts and links, whereby support is provided therebetween, and further such that each of the looped tails is received in said respective openings;

each of the tails including at least one fastening means formed thereon for cooperating with said respective notch formed on the wall in the openings in which the tails are received, whereby each of the tails may be secured in the respective openings.

10. A handle for a suitcase and an attache case of the type having a pair of posts formed thereon, the handle comprised of:

a body portion including a pair of ends, each of the ends of the body portion having a respective opening formed therein;

each of the ends of the body portion having a respective tail formed thereon and integral therewith, so that each of the tails loops around the respective posts; and fastening means to connect each of the tails to the respective openings in the ends of the body portion.

* * * * *